United States Patent [19]

Combette et al.

[11] Patent Number: 4,983,256

[45] Date of Patent: Jan. 8, 1991

[54] METHOD FOR THE MANUFACTURE OF A PAPER PULP FOR CURRENCY USE

[75] Inventors: Philippe Combette, Firminy; Robert. Angelier, Echirolles; Christian Vieu, Pavillon Banque, all of France

[73] Assignees: Clextral, Firminy; Centre Technique de L'Industries des Papiers Cartons et Cellulose, Grenoble; Banque de Frane, Paris, all of France

[21] Appl. No.: 333,937

[22] Filed: Apr. 6, 1989

[30] Foreign Application Priority Data

Apr. 6, 1988 [FR] France ..... 88 04548

[51] Int. Cl.[5] ..... D21C 3/26; D21C 9/10; D21H 27/00

[52] U.S. Cl. ..... 162/18; 162/19; 162/25; 162/56; 162/60; 162/140

[58] Field of Search ..... 162/236, 19, 52, 56, 162/18, 25, 140, 60

[56] References Cited

U.S. PATENT DOCUMENTS

| | | | |
|---|---|---|---|
| 4,088,528 | 5/1978 | Berger et al. | 162/236 |
| 4,214,927 | 7/1980 | Berger | 162/18 |
| 4,563,243 | 1/1986 | Koch | 162/19 |

OTHER PUBLICATIONS

Chouders et al., ABIPC Abstract No. 537, "Bleached Chemimechanical Pulps" Obtained by the Bi-Vis, 2-1987.

*Primary Examiner*—Steve Alvo

*Attorney, Agent, or Firm*—Pollock, Vande Sande & Priddy

[57] ABSTRACT

In the method for the manufacture of a paper pulp for currency use from a stock comprising textile fibers, the operations of boiling, bleaching, chopping, breaking, cutting and washing of the textile fibers are performed in at least one treatment machine (10, 40) of the type having two co-rotating screws, in a plurality of phases taking place successively and continuously. The operations include a phase of feeding and mixing the stock with water, at least oen compression phase, at least one phase of shearing of the textile fibers, at least one phase of treatment of introduction of boiling and bleaching reagents, at least one phase of washing of the bleached pulp by introduction of washing water, and a phase of transferring and evacuating the bleached and washed pulp.

7 Claims, 5 Drawing Sheets

METHOD FOR THE MANUFACTURE OF A PAPER PULP FOR CURRENCY USE

FIELD OF THE INVENTION

The present invention relates to a method of manufacturing a paper pulp for currency use, and relates more particularly to the manufacture of a paper pulp obtained from textile fibers such as cotton, ramie or linen and intended for the production of a very high-quality paper such as that used in the manufacture of banknotes.

BACKGROUND OF THE INVENTION

It is known that this type of paper must particular have specific mechanical properties, namely high breaking strain and folding resistance, and which are homogeneity and texture which are appropriate for the production of a watermark. Moreover, the paper must satisfy very stringent criteria particularly in respect of its dimensional stability, its optical brightness and its cleaness.

The traditional preparation of a paper pulp intended for the manufacture of a banknote paper is carried out in a plurality of distinct steps.

Firstly, the material, generally comprising cotton fibers originating either from comber wastes or in the form of textile wastes, or comprising other textile fibers such as ramie or linen, is initially subjected to coarse chopping and is placed in a bin. The fibers and/or aggregations of fibers are then compacted by means of a pestle in a rotating chest, as a result of which, on emerging from this apparatus the stock is in the form of annular rings.

The annular rings, also called "cakes" are then introduced into a digester where the boiling and bleaching operations are carried out jointly with the aid of an aqueous solution of caustic soda and hydrogen peroxide. This operation is carried out under a pressure in the vicinity of atmospheric pressure and at a temperature of the order of 90° to 95° C. While the bleached cakes are still in the digester, they are washed with clean water in order to remove the boiling and bleaching reagents.

The compacting operation, carried out with the aid of the pestle, before introduction into the digester, essentially serves to increase the density of the stock so as to make optimum use of the volume of the said digester.

The bleached and washed cakes, after extraction from the digester, are chopped by means of a special machine of the milling cutter type.

The stock is then treated in breaker engines or with the aid of another system suited for this fibrous stock. This operation, carried out in water, furthermore makes it possible to separate the textile fibers and to cut them uniformly into 3 to 4 mm lengths.

The fibers thus obtained, still accompanied by water, are introduced into a stuff chest and constitute the first stuff or half-stuff.

The first stuff then passes to a disc-type refiner where the fibers are refined. This operation modifies the physical structure of the fibers and imparts to the paper the physical and mechanical properties required for currency use.

The whole stuff then enters a mixing chest in which is added pulp originating from the recycling of reeler or trimmer shavings and brakes. This mixing chest then feeds a stuff chest situated at the head of the paper machine as such.

It can be seen, therefore, that the traditional manufacture of a banknote paper corresponds to a discontinuous method, and entails numerous handling operations to load and unload the items of apparatus, more particularly for the stamping of the cakes and the boiling and milling of the bleached cakes.

SUMMARY OF THE INVENTION

The object of the present invention is to provide a method which avoids the above-mentioned disadvantages and makes it possible to prepare the paper pulp continuously, with no interruption of loading in the line of preparation of the pulp, from the bin for distribution after chopping of the stock to the obtaining of the half-stuff or first stuff before refining.

Moreover, the method according to the invention makes possible a considerable reduction in the energy consumption conventionally needed to produce such a pulp.

The invention therefore relates to a method for the manufacture of a paper pulp for currency use, particularly for banknotes, from a stock furnished with textile fibers such as cotton, ramie or linen, comprising successively:

- an operation of chopping the stock,
- a boiling and bleaching operation,
- an operation of chopping the boiled and bleached textile fibers,
- breaking and washing operation in order to separate, cut and wash the textile fibers,
- a mixing operation in a stuff chest to obtain a first stuff or half-stuff,
- a refining operation to obtain a whole stuff, characterized in that the operations of boiling, bleaching, chopping, breaking, cutting and washing the textile fibers are performed in a continuous manner in at least one treatment machine of the type having two co-rotating screws.

According to an essential feature of the invention, the operations which take place continuously in the treatment machine comprise:

- at least one phase of feeding and mixing of the stock and the water, or the recycling waters,
- at least one phase of compression,
- at least one phase of shearing of the textile fibers,
- at least one phase of treatment by introducing boiling and bleaching reagents,
- at least one phase of washing the bleached pulp with introduction of the washing water, and
- at least one a phase of transferring and evacuating the bleached and washed pulp.

According to another feature of the invention, the operations of boiling, bleaching and chopping the textile fibers are performed in a first treatment machine of the type having two co-rotating screws to obtain a bleached pulp, and the breaking, cutting and washing operations are performed in a second treatment machine of the type having two co-rotating screws to obtain a bleached and washed pulp, the bleaching operation being completed in a holding vessel equipped with means for transporting the pulp and interposed between the two treatment machines.

BRIEF DESCRIPTION OF THE DRAWINGS

Other features and advantages of the present invention will become apparent in the course of the description which follows and which is given with reference to the attached drawings, in which.

DESCRIPTION OF PREFERRED EMBODIMENT

In the description which follows it has been assumed by way of example that the stock comprises cotton fibers originating either from comber wastes or in the form of rags, but other textile fibers such as ramie and linen may be used.

Figure 1:
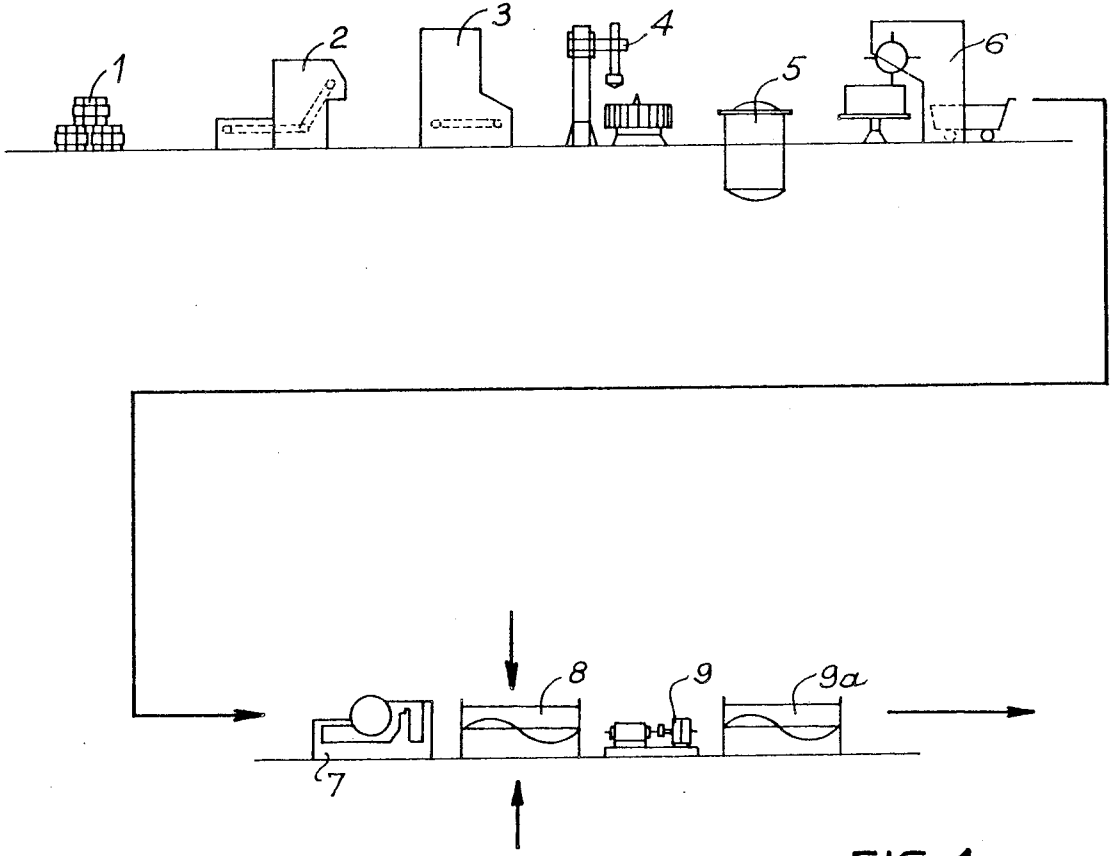
FIG. 1 shows schematically an installation for carrying out the conventional method of manufacturing paper pulp for currency use.

In the conventional installation shown in FIG. 1, the material in the form of bales 1 of textile fibers is first coarsely chopped in a bale billowing machine 2 and introduced into a distribution bin 3. The fibers are then compacted by means of a pestle in a rotating chest 4, and hence on emerging from from this apparatus the stock is in the form of annular rings.

The annular rings are then admitted to the digester 5 where the boiling and bleaching operations are carried out jointly with the aid of an aqueous solution of caustic soda and hydrogen peroxide. The bleached rings still located in the digester 5 are then washed with clean water to eliminate the boiling and bleaching reagents.

Bleached, washed rings, after extraction from the digester 5, are chopped by means of an apparatus of the milling cutter type 6.

The stuff is then treated in a breaker 7. This operation, carried out in water, makes it possible not only to separate the textile fibers but also to cut them in a uniform manner. The fibers thus obtained, still accompanied by water, are introduced into a stuff chest 8 and form the first stuff or half-stuff.

The first stuff then passes to a beater 9, and the resulting whole stuff is then admitted to a mixing chest 9*a* in which is added pulp originating from the recycling of the reeler or trimmer shavings and of the brokes. This mixing chest then feeds a stuff chest (not shown), situated at the head of the paper machine as such.

Figure 2:
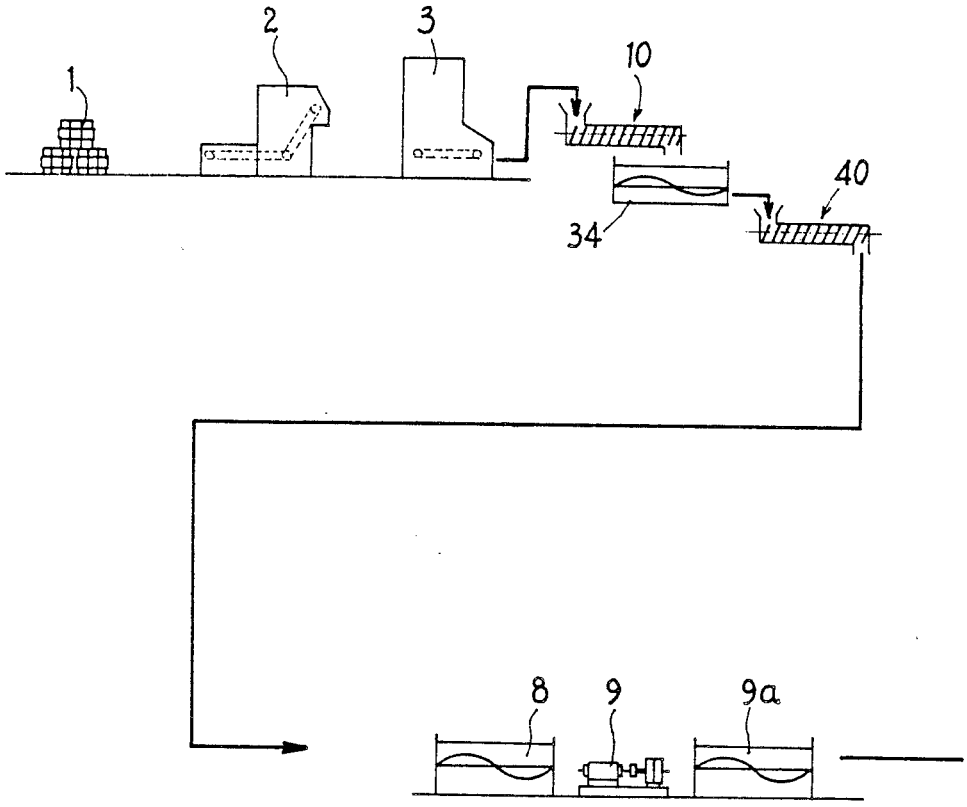
FIG. 2 shows schematically the various phases and the apparatus employed in the method according to the present invention.

In the installation for implementing the method according to the present invention, shown in FIG. 2, at the outlet of the distribution bin 3 the textile fibers accompanied by water are then introduced into a first treatment machine 10 of the type having two co-rotating screws.

Figure 3:
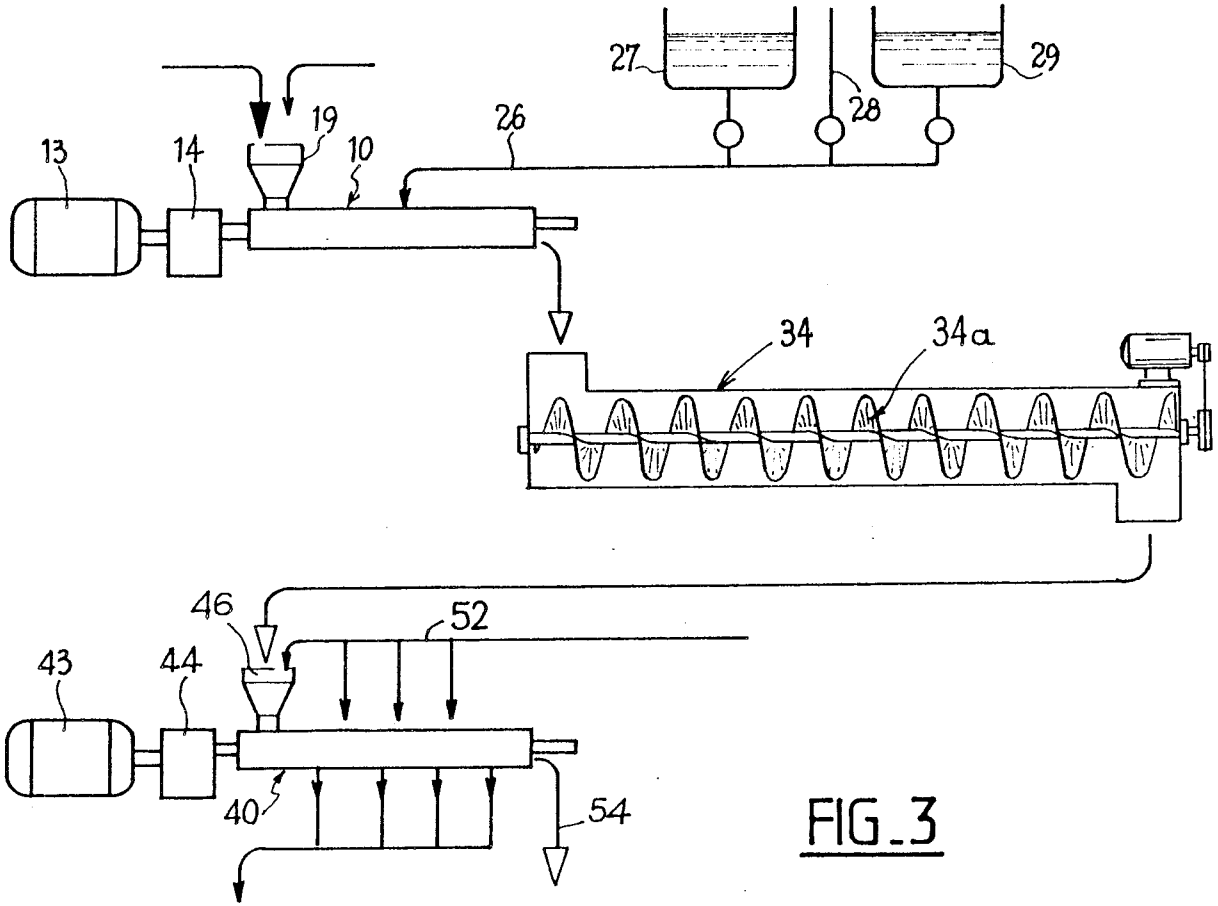
FIG. 3 is a schematically view of the general arrangement of the treatment machines utilized in the method.
Figure 4:
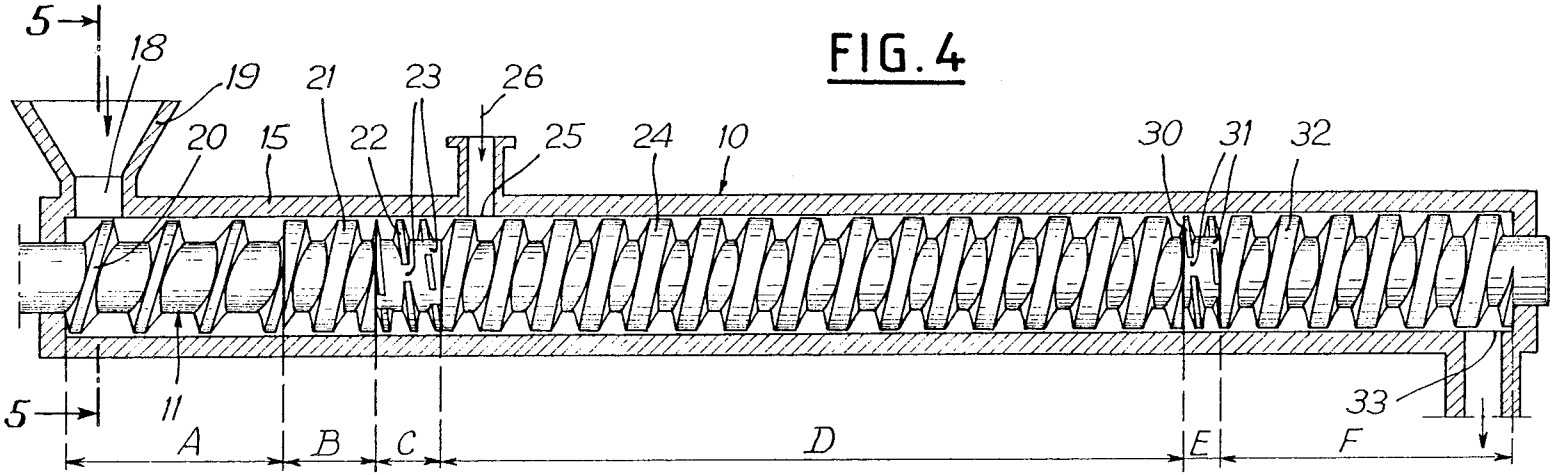
FIG. 4 is a sectional view in a vertical plane passing through the axis of a screw of the first treatment machine.
Figure 5:
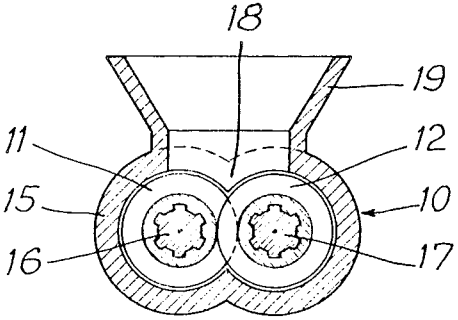
FIG. 5 is a sectional view along line V—V in FIG. 4.

As shown in FIGS. 3, 4 and 5, the first treatment machine 10 comprises at least two screws 11 and 12 driven to rotate about their axes by a motor 13 and a reducing gear 14 (FIG. 3) within an elongate enclosure forming a sheath 15 which envelops them. The screws 11 and 12 are provided with helical threads which engage in one another, and the inside wall of the sheath forms two secant cylindrical lobes, of an internal diameter slightly greater than the external diameter of the threads. These threads are fitted into each other, and the two screws are driven at the same speed of rotation and in the same direction, in a manner such that the two screws are identical, the threads being simply offset relative to each other.

The screws 11 and 12 are advantageously formed by fluted shafts 16 and 17, respectively, on which are stacked screw sections formed by sleeves. The internal bore of the sleeves is provided with flutings corresponding to those of the shaft, and the external part is provided with helical threads whose pitch differs according to the section in question for the treatment and the transportation of the material. It is thus possible to have available a fairly large number of sections, making it possible to vary the pitch, the depth, the number of threads and the length of each zone.

Thus, the first treatment machine 10 comprises a plurality of successive zones, each corresponding to a particular function:

A first zone A for feeding and mixing the material and the water, a second zone B for compression, a third zone C for shearing, a fourth zone D for conveying and treatment, a fifth zone E for shearing, and a sixth zone F for transferring and evacuating the bleached pulp.

In the first zone A for feeding and mixing textile fibers such as those obtained from chopping the bales, and water, the sheath is pierced by a feed aperture 18 surmounted by a hopper 19 for introducing the products. In this zone, screws 11 and 12 are provided with threads 20 having a wide pitch and a reduced section, in order to ensure the transfer of the products introduced through this aperture 18 which opens broadly on the two screws 11 and 12 in order to spread the material in the threads 20.

The textile fibers and the water, or possibly the effluent originating from the second treatment machine 40, are then immediately transported downstream of the treatment machine and mixed by the rotating and engaging action of the screws 11 and 12.

In zone B, the screws have threads 21 of a narrow pitch and thicker section, so that mixing of the products is supplemented by compression of the latter.

The material then passes to a shearing zone C.

To this end, zone C is provided with helical threads 22 whose direction of winding is the inverse of that undertaking the transfer of the material in the treatment machine 10. These threads 22 contain apertures 23 are made which extend radially from the core of each screw 11 and 12 to the periphery of the threads and which are furthermore regularly distributed about the axis. The screws 11 and 12 are fixed in a manner such that the two apertures 23 regularly coincide in the central meshing zone. In this manner, the downstream passage of the flow of material is controlled, which results in a braking in this zone C and a compression effect upstream. Moreover, substantial shearing of the material takes place, which homogenizes the mixture, improves the impregnation of the textile fibers with the water, and also constitutes a first phase of breaking and cutting of the threads. Moreover, these shearing and mixing operations both in zone C and, although to a lesser extent, in zone B, entail the heating of the material, a major part of the mechanical work being converted to heat energy. Hence, on emerging from its passage in zone C, without external provision of heat, the material is at a temperature of the order of 95° C. which makes it suitable for undergoing the treatment operation in the zone which follows.

Zone D, the conveying and treatment zone, is provided with threads 24 whose pitch and thickness have features approximating those of zone B. In the upstream part of zone D, the sheath is provided with an aperture 25 connected to an inlet line 26 for the boiling and bleaching reagents which comprise, in particular an aqueous solution of soda, water and hydrogen peroxide, optionally accompanied by sequestering agents and stabilizers. These reagents originate from a metering and injection station which comprises a storage tank 27 for the aqueous soda solution, water feed lines 28 and a storage tank 29 for hydrogen peroxide (FIG. 2). Hence, all along this zone D, the textile material will be kneaded and mixed with these reagents in order to ensure this boiling and bleaching step which is essential in the manufacture of paper pulp.

The treatment machine of the type having two co-rotating screws is particularly well suited for carrying out this operation. This is because, as a result of the rotation of the screws in the same direction, the material is returned into the zone of interpenetration of the threads, which is particularly effective in respect of its mixing, making it possible to bring about intimate mixing of the reagents and of the textile fibers which have been in the waterimpregnated upstream zones. In this manner, better utilization of the reagents is obtained, which is reflected both in economical use of the said reagents and in the reduction, in the subsequent phases, of the clean washing water and hence of the effluents produced by the installation.

Moreover, this mixing effort is accompanied by internal heating of the material, and with no external supply of heat, the temperature of the latter will be maintained at a value of 90° or 95° C., compatible with a good reaction kinetics, with no thermal impairment of the paper pulp.

The conveying and treatment zone D is followed by a zone E which is a braking zone constituted, like zone C, by helical threads 30 whose winding is opposite to that which propels material, in other words counterthreads, and likewise comprising passage windows 31. Physical and thermal phenomena and the functions performed in this zone E are similar to those of in zone C, i.e., substantial shearing and mixing together with breaking and cutting of the fibers.

The last section of the treatment machine 10, constituted by zone F, comprises threads 32 whose pitch and thickness are similar to those in zone D. The boiling and bleaching reactions continue during the flow of the material in this zone which, moreover, is responsible for transfer towards the outlet aperture 33, formed by a single aperture at the downstream end of the sheath 15.

At the outlet from this first treatment machine 10 there is thus a flow, under atmospheric pressure and at a temperature of the order of 80° C. to 100° C., of pulp which is bleached but which still contains the residual reagents and the products originating from the action of these reagents on the original material.

This pulp is admitted via a single flow duct (not shown) into the retention vessel 34 (FIGS. 2 and 3). This vessel 34, whose central function is to complete the bleaching reaction, comprises a screw conveyor system 34a intended to transport the pulp towards the second treatment machine 40.

This retention vessel 34 is of a size such as to accommodate a relatively short residence time of between 10 and 30 minutes.

Figure 6:
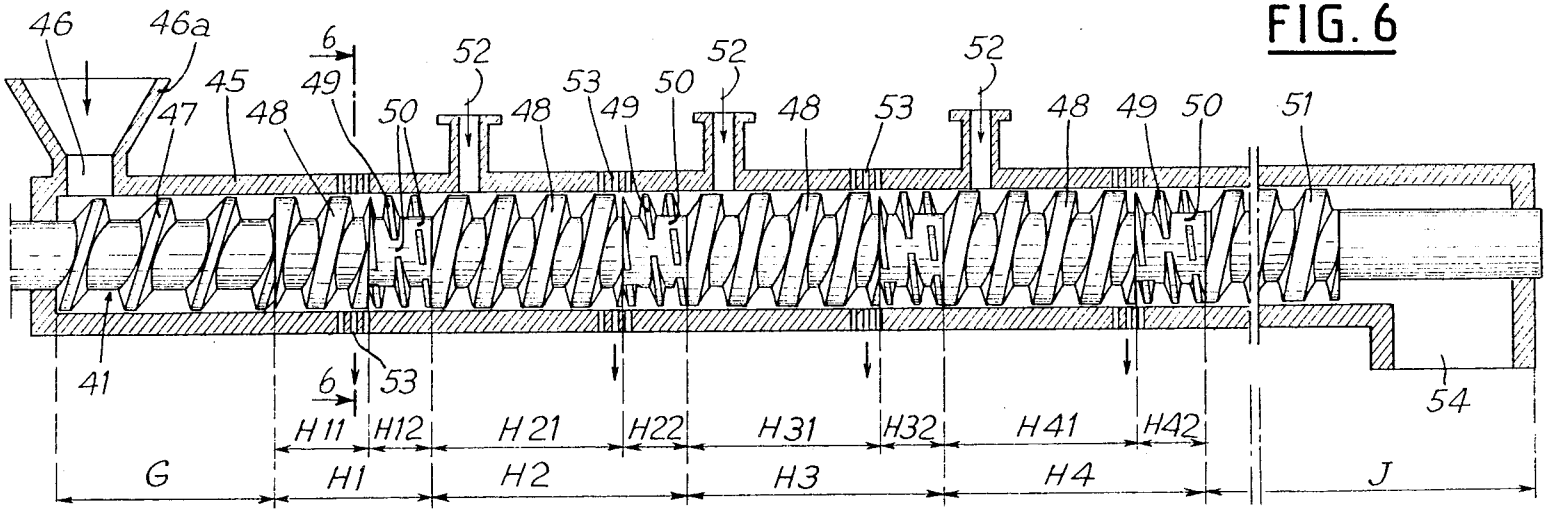
FIG. 6 is a sectional view through a vertical plane passing through the axis of a screw of the second treatment machine.
Figure 7:
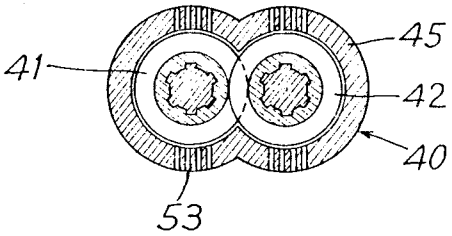
FIG. 7 is a sectional view along line 6—6 of FIG. 6.

The second treatment machine 40 (FIGS. 6,7) is similar in its general conception to the first treatment machine 10. It comprises at least two screws 41 and 42 which are driven for rotation about their axes by a motor 43 and a reducing gear 44 (FIG. 3) within an elongate enclosure forming a sheath 45 which encompasses them. The screws 41 and 42 are provided with helical threads which mesh with one another, and the inner wall of the sheath forms two secant cylindrical lobes of an internal diameter slightly greater than the external diameter of the threads. The threads fit into one another, and the two screws are driven at the same speed of rotation and in the same direction, in a manner such that the two screws are identical, the threads simply being offset relative to one another.

This treatment machine 40 comprises a plurality of successive zones each corresponding to a particular function:

- a first zone G for feeding and mixing the bleached pulp and the washing water,
- a plurality of zones H for compressing, shearing and washing the pulp, and
- a downstream zone J for transferring and evacuating the bleached and washed pulp.

In the first zone G for feeding and mixing the bleached pulp coming from the retention vessel 34, at a temperature of the order of 65° to 70° C., with a fraction of the washing water, the sheath is pierced by an intake aperture 46 surmounted by a hopper 46a for introducing the products. In this zone G, the screws 41 and 42 are fitted with screws 47 having a wide pitch and a reduced section to ensure the transfer of the products produced through this aperture 46 which opens broadly on the two screws 41 and 42 in order to spread the material in the threads.

The bleached pulp and this first fraction of washing water are then immediately transported downstream in the treatment machine 40, and mixed by the action of rotation and meshing of the screws 41 and 42.

Thus the pulp passes into a succession of zones H1, H2 . . . which are similar in their construction and in their function. In the example shown, the treatment machine 40 comprises four zones of type H, which is a compromise in respect to the production of the treatment machine and the characteristics of the pulp obtained. It is clear that the method to which the present invention relates is equally applicable to design solutions comprising a greater number of these sections H and modifying the geometrical characteristics of the threads.

Each zone H, for example zone H1, comprises a first compression and washing zone element H11 and a second braking and shearing zone element H12.

In zone element H11, the screws comprise threads 48 with a narrow pitch and a thicker section than that of the thread 47 of zone G. In this manner mixing of the products is supplemented by compression of the fibrous stock. Hence, all along the element H11, the bleached pulp is stirred and mixed with the washing water introduced into the feed hopper 46a in order to eliminate the residual reagents and products originating from the action of the reagents on the pulp. Downstream of zone H11, where compression is maximum, the washing effluents are evacuated by means of filters 53 selectively positioned in the sheath 45.

Zone element H12 is provided with threads 49 whose direction of winding is the reverse of that enabling the transfer of the stock into the treatment machine 40. These threads 49 contain apertures 50 which extend radially from the core of each screw 41, 42 to the periphery of the threads and are regularly distributed about the axis. The screws 41 and 42 are fixed so that two apertures 50 regularly come into alignment in the central meshing zone. In this way, the downstream passage of the flow of pulp is controlled, which produces braking in this zone H12 and a compression effect upstream. Moreover, substantial shearing of the pulp takes place, which in addition to the homogenization of the latter constitutes a phase of breaking and cutting of the fibers.

Moreover, as in the first treatment machine, these shearing and mixing operations in the braking zones and also, although to a lesser extent, in the other zones, entail heating of the pulp, a substantial part of the mechanical work being converted into heat energy. Hence the pulp is brought to a temperature of the order of 90° C., which improves the efficacy of the washing operation.

In the upstream part of element H21, the sheath 45 is connected to an inlet line 52 for clean washing water. Hence, all along element H21, the bleached pulp is stirred and mixed with the washing water in order to eliminate the residual reagents and the products originating from the action of the reagents on the pulp.

It should be noted that the treatment machine of the type having two co-rotating screws is particularly suited for performing this washing operation in a manner which is efficient and economical in respect of the volume of water used. Because of the rotation of the screws 41 and 42 in the same direction, the pulp is returned into the zone of interpenetration of the threads; this is particularly effective in producing intimate mixing of pulp with the washing water, which results in economical use of the latter.

The pulp thus passes successively into zones H1, H2, H3 and H4, where the pulp washing and breaking operations take place in an identical manner.

The outlets for the washing effluents are produced by means of filters 53 in the downstream parts of the elements of zones H11, H21, H31 and H41.

In the example shown, it has been assumed that the three injections of clean water into zones H2, H3 and H4, together with those at the level of the intake of the bleached pulp in zone G, have occurred in parallel relative to a general collector (not shown). It is apparent that a different arrangement of the series type may be produced without departing from the scope of the present invention. In this event, the total flow of washing water is injected into zone H41, the effluents of zone H41 are introduced into zone H31 and so on as far as zone G, i.e., in countercurrent relative to the general flow of pulp in the treatment machine 40.

Part of these effluents, containing the unconsumed chemical reagents, can if desired be recovered in order to be recycled into the first treatment machine 10.

Zone J, which constitutes the downstream outlet section for the pulp, is similar to elements H11, H21, H31 and H41 and comprises threads 51 similar to threads 48. Its essential function is to transfer the bleached and washed pulp, which exits from the treatment machine 40 through an aperture 54 and is then admitted directly into the half-stuff chest 8 upstream of the beater 9 (FIG. 2) and of the paper machine.

The method according to the present invention can likewise be utilized by a single treatment machine of the type having two co-rotating screws providing in an upstream part all the functions of the first treatment machine and in a downstream part all the functions of the second treatment machine.

The paper pulp obtained by means of the method according to the present invention makes it possible to produce paper which conforms in every way to what is required in the traditional manufacture of banknote paper.

The tables which follow compare the characteristics of the papers obtained by the conventional method with those obtained by the method according to the present invention.

| Mass concentration of reagents used relative to the mass of dry cotton | | |
|---|---|---|
| | Traditional method | Method according to the present invention |
| Caustic soda | 4% | 1% |
| Hydrogen peroxide | 4.8% | 4% |
| Stabilizer | 0.002% | 0% |

| Physical and mechanical properties |
|---|
| Measurement conditions |
| The paper samples were packaged in accordance with standard NF Q03-010 (23° C. 50% HR) |
| Folding, in accordance with standard NF Q03-001 |
| unsized paper: LHOMARGY fold tester fitted with a weight of 16 N |
| sized paper: LHOMARGY fold tester fitted with a weight of 20 N |
| Traction, in accordance with standard NF Q03-004 |
| INSTROM type 1026 dynamometer |
| Brightness, in accordance with standard NF Q03-039 |
| ELREPHO photometer fitted with a gloss trap |
| Opacity of paper base, in accordance with standard NF Q03-040 |
| ELREPHO photometer |
| Glaze or gloss, in accordance with standard NF Q03-012 |
| BEKK type 131 ED gloss measurement apparatus |

| Physical and mechanical properties of the papers obtained | | |
|---|---|---|
| | Traditional method | Method according to the present invention |
| Beating index of the pulp, degrees Shopper-Riegler | 81 | 80 |
| Substance of unsized paper, g/m² | 53.1 | 53.8 |
| Substance of sized paper g/m² | 61.5 | 62.6 |
| Folding, unsized | | |
| machine direction | 175 | 330 |
| cross direction | 17 | 21 |
| Folding of sized paper | | |
| machine direction | 1177 | 1783 |
| cross direction | 151 | 284 |
| Brightness % | 86.2 | 84.1 |
| Opacity % | 75.6 | 75.1 |
| Glaze s | 22–40 | 20–37 |
| Breaking strain in da.N | | |
| machine direction | 6.8 | 7.8 |
| cross direction | 3.4 | 3.9 |

-continued

| Physical and mechanical properties of the papers obtained | | |
|---|---|---|
| | Traditional method | Method according to the present invention |
| Breaking length in m | | |
| machine direction | 7371 | 8470 |
| cross direction | 3686 | 4240 |
| Elongation at break in % | | |
| machine direction | 4.7 | 4.9 |
| cross direction | 5.3 | 4.8 |

These results were obtained with a pulp production line in accordance with FIG. 2, the refining and the paper machine being clearly identical to the traditional comparison method shown in FIG. 1.

At the outlet from the second treatment machine, the measures carried out on the residual caustic soda content given an efficacy of 85 to 90% for washing.

A further advantage of the method according to the present invention lies in the savings of energy consumption and washing water. The results below unambiguously show the savings achieved.

A consumption of 900 to 1100 kwh/ton of dry pulp by the method according to the present invention, instead of 2200 to 2400 kwh/ton of pulp in the traditional method.

A washing water consumption of 8 to 10 tons/tonne of dry pulp by the method according to the present invention instead of 100 tons of dry pulp in the traditional method.

Thus the method according to the present invention makes it possible to obtain paper pulp for currency use having the same properties as for the traditional method, with a continuous production line, and to reduce the consumption of energy and of water.

Moreover, the washing water savings thus achieved mean that the volume of effluents generated in the making of this paper is much lower, and consequently the treatment of these effluents is less costly and less nuisance is caused.

Finally, the method according to the present invention makes it possible to eliminate maintenance operations for loading and unloading apparatus, such as the pestle, the digester, the milling cutter and the breaker engines which are necessary in the traditional method.

We claim:

1. Method for the manufacture of a paper pulp for currency use from stock containing textile fibers, said method comprising the successive steps of (a) chopping said stock;

(b) boiling and bleaching said stock;

(c) chopping and boiled and bleached textile fibers;

(d) breaking and washing said textile fibers in order to separate, cut and wash said textile fibers;

(e) mixing said textile fibers in a stuff chest to obtain a first stuff or half-stuff;

(f) refining said mixed textile fibers to obtain a whole stuff;

(g) said steps (b) and (c) being performed in a continuous manner in a first treatment machine (10) of a type having two co-rotating screws (10, 12) to obtain bleached pulp;

(h) said step (d) being performed in a continuous manner in a second treatment machine (40) of a type having two co-rotating screws (41, 42) to obtain bleached and washed pulp;

(i) bleaching being completed during a retention period of 10 to 30 minutes in a retention vessel (34) provided with means (34a) for transporting said pulp, said retention vessel being interposed between said first and second treatment machines (10, 40);

(j) said steps (b) and (c) taking place continuously in said first treatment machine (10) comprising (i) a phase (A) of feeding and mixing of said stock with water, or recycling waters;

(ii) at least one phase (B) of compression;

(iii) at least one phase (C, E) of shearing of said textile fibers; and (iv) at least one phase (D) of treatment by introducing boiling and bleaching reagents;

(k) said step (d) taking place continuously in said second treatment machine (40) comprising (v) at lest one phase (H11, H21 . . . ) of washing said pulp after bleaching by introducing washing water; and (vi) a phase (J) of transferring and evacuating said pulp into said retention vessel (34) after bleaching and washing.

2. Method according to claim 1 wherein, during said phases (C, E) of shearing and said phase (D) of treatment, said stock is at a temperature of the order of 90° to 95° C.

3. Method according to claim 1, wherein said first treatment machine (10) continuously comprises, from upstream to downstream in the transport direction, a phase (A) of feeding and mixing said stock and said water, a compression phase (B), a shearing phase (C), a phase (D) of conveying and treatment with introduction, at the start of this phase (D), of boiling and bleaching reagents comprising an aqueous solution of caustic soda and hydrogen peroxide, a further shearing phase (E), and a final phase (F) of transporting and evacuating the bleached pulp into said retention vessel (34).

4. Method according to claim 3, wherein, at the outlet from said final phase (F), the bleached pulp is at a temperature of the order of 80° C.

5. Method according to claim 1, wherein said second treatment machine (40) continuously comprises, from upstream to downstream in the transport direction, respectively, (a) a phase G of feeding and mixing bleached pulp coming from said retention vessel (34) and the washing water, (b) a succession of phases (H1, H2 . . . ) of compressing, shearing and washing said pulp, and a final phase (J) of transferring and evacuating said bleached and washed pulp.

6. Method according to claim 5, wherein each phase (H1, H2 . . . ) comprises a first, mixing phase (H11, H21 . . . ) with introduction (46, 52), at a start of said first, mixing phase, of washing water, and with evacuation (53), at an end of said first, mixing phase, of said effluents, and a second, shearing phase (H12, H22 . . . ).

7. Method according to claim 5, wherein in said phase G of feeding and mixing the bleached pulp and water, said bleached pulp is at a temperature of the order of 65° to 70° C.

* * * * *

UNITED STATES PATENT AND TRADEMARK OFFICE

CERTIFICATE OF CORRECTION

PATENT NO. : 4,983,256

DATED : JANUARY 8, 1991

INVENTOR(S) : COMBETTE ET AL.

It is certified that error appears in the above-identified patent and that said Letters Patent is hereby corrected as shown below:

Title page:

In item 73 of the patent document, the word "L'Industries" should be changed to --L'Industrie--; and the word "Frane" should be changed to --France--

In item 75 of the patent document, the name of the second inventor "Robert. Angelier" should be changed to read: --Robert Angelier--

In column 10, line 22, the word "least" has been misspelled.

Signed and Sealed this

Ninth Day of February, 1993

*Attest:*

STEPHEN G. KUNIN

*Attesting Officer*

*Acting Commissioner of Patents and Trademarks*